US009231341B2

(12) United States Patent
Appel

(10) Patent No.: US 9,231,341 B2
(45) Date of Patent: Jan. 5, 2016

(54) HAND-HELD POWER TOOL

(75) Inventor: Hans Appel, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 647 days.

(21) Appl. No.: 13/570,036

(22) Filed: Aug. 8, 2012

(65) Prior Publication Data

US 2013/0210257 A1 Aug. 15, 2013

(30) Foreign Application Priority Data

Aug. 11, 2011 (DE) ..... 10 2011 080 815

(51) Int. Cl.

| | |
|---|---|
| ***B25D 17/00*** | (2006.01) |
| ***H01R 13/623*** | (2006.01) |
| ***H01R 13/627*** | (2006.01) |
| ***H01R 13/625*** | (2006.01) |
| ***B25F 5/00*** | (2006.01) |

(52) U.S. Cl.

CPC ..... *H01R 13/625* (2013.01); *B25D 17/00* (2013.01); *B25F 5/00* (2013.01); *B25D 2250/041* (2013.01)

(58) Field of Classification Search

CPC ..... H01R 13/625; H01R 13/627
USPC ..... 173/213, 217, 170, 171; 439/332
See application file for complete search history.

(56) References Cited

U.S. PATENT DOCUMENTS

| | | | | |
|---|---|---|---|---|
| 2,152,125 | A * | 3/1939 | Wulle | 439/319 |
| 4,066,315 | A * | 1/1978 | Arneson | 439/311 |
| 2003/0070822 | A1 * | 4/2003 | Kanzaki et al. | 173/217 |
| 2004/0038584 | A1 * | 2/2004 | Zahlit et al. | 439/489 |

FOREIGN PATENT DOCUMENTS

| | | | |
|---|---|---|---|
| DE | 195 21 754 | B4 | 12/1996 |
| DE | 10 2004 035 390 | A1 | 3/2006 |
| GB | 2 236 221 | A | 3/1991 |

OTHER PUBLICATIONS

German Search Report, dated Apr. 27, 2012, 5 pages.
German Office Action issued in counterpart German Application No. 10 2011 080 815.9 dated Aug. 14, 2015 (Five (5) pages).

* cited by examiner

*Primary Examiner* — Michelle Lopez
(74) *Attorney, Agent, or Firm* — Crowell & Moring LLP

(57) ABSTRACT

A hand-held power tool is disclosed. The tool has a tool receptacle, an electric motor which drives the tool receptacle, and a machine housing. A two-part supply cable has a first section, which is mechanically fastened inside the machine housing, and a second section, which is coupled to the first section outside of the machine housing by a detachable plug connection. The detachable plug connection locks by rotating around an axis and unlocks along the axis in the case of a tensile load above a limit value.

8 Claims, 3 Drawing Sheets

HAND-HELD POWER TOOL

This application claims the priority of German Patent Document No. DE 10 2011 080 815.9, filed Aug. 11, 2011, the disclosure of which is expressly incorporated by reference herein.

BACKGROUND AND SUMMARY OF THE INVENTION

The present invention relates to an electrical hand-held power tool, in particular a hammer drill and a saw. The hand-held power tool is attached to an electrical network for the supply of power via a supply cable. In the case of improper operation, a tool—e.g., a chisel—may sever the supply cable.

The hand-held power tool, according to the invention, has a tool receptacle, an electric motor which drives the tool receptacle, and machine housing. A two-part supply cable has a first section, which is mechanically fastened inside the machine housing, and a second section, which is coupled to the first section outside the machine housing by a detachable plug connection. The detachable plug connection has a locking mechanism, which is locked so that it can rotate around an axis and unlocks along the axis in the case of a tensile load above a limit value.

The plug connection constitutes a mechanical weak point in the supply cable. Due to the possibility of rupturing the plug connection, care must be taken in this case that no stranded wires or current-carrying contacts are exposed. As a result, the plug connection is provided with an overload protection, which forcibly opens the plug connection in a controlled manner in the event of a corresponding tensile load. The limit value for the tensile load is preferably greater than a weight force of the hand-held power tool, which is typically between 30 N and 300 N. In an emergency, an operator is able to lift the hand-held power tool by the supply cable without the plug connection disconnecting.

The locking mechanism has a rotating mechanism for manual locking and unlocking. The different actuation direction of the rotating mechanism, compared to the forcible unlocking triggered along the axis, decouples the rotating mechanism from the forcible unlocking. As a result, the closure mechanism is able to be actuated by an operator with a low expenditure of force. The second section of the supply cable is able to be replaced without great expense.

One embodiment provides that a first half of the locking mechanism contains a peg. A second half of the locking mechanism contains a connecting member guiding the peg. The connecting member connects two openings that point in the direction of the first half of the locking mechanism and are arranged offset in the circumferential direction. A spring-loaded barrier element engages in the connecting member. The peg is able to be introduced in the case of the one opening without an expenditure of force and be pushed using a rotary movement toward the back of the barrier element. The barrier element prevents the peg from being able to exit from the second opening in case of a low tensile force. The connecting member may have a route running monotonically along the axis between the second opening and the spring-loaded barrier element. When the barrier element is disengaged because of a great tensile force, it is possible for the peg to be pulled free along the monotonic route up to the second opening because of the tensile force. One embodiment provides that the connecting member have a further route from the first opening to the spring-loaded barrier element, wherein the further route has a change in direction with respect to the axis. In the case of applied tensile force, the peg is pulled to the barrier element and not to the first opening. If an operator wants to disengage the closure mechanism, he/she must first move the peg against the tensile force to the change in direction and then rotate it in the direction of the first opening.

A route section of the connecting member running parallel to the circumferential direction ends adjacent to the spring-loaded barrier element. This route section prevents the peg from running back to the first opening when a tensile force is applied.

One embodiment provides that the one plug connection half include a sleeve, from which the peg projects radially, and the other plug connection half includes a sleeve, in which the connecting member is configured as a groove countersunk in the radial direction. The sleeves are mutually rotatable. Moreover, the sleeves may enclose an electrical contact area.

One embodiment provides that the electrical contact area includes a socket with a first electrical contact and a plug with a second electrical contact, wherein the first contact is open in the circumferential direction for receiving the second contact. The electrical connection is established at the same time as the rotation to close the closure mechanism, or the electrical connection is interrupted with the rotation to unlock the electrical connection. An angular alignment of the first contact with respect to the peg may be equal to an angular alignment of the second contact with respect to the one opening of the connecting member.

The following description explains the invention on the basis of exemplary embodiments and figures.

DETAILED DESCRIPTION OF THE DRAWINGS

Unless otherwise indicated, the same or functionally equivalent elements are identified by the same reference numbers in the figures.

Figure 1:
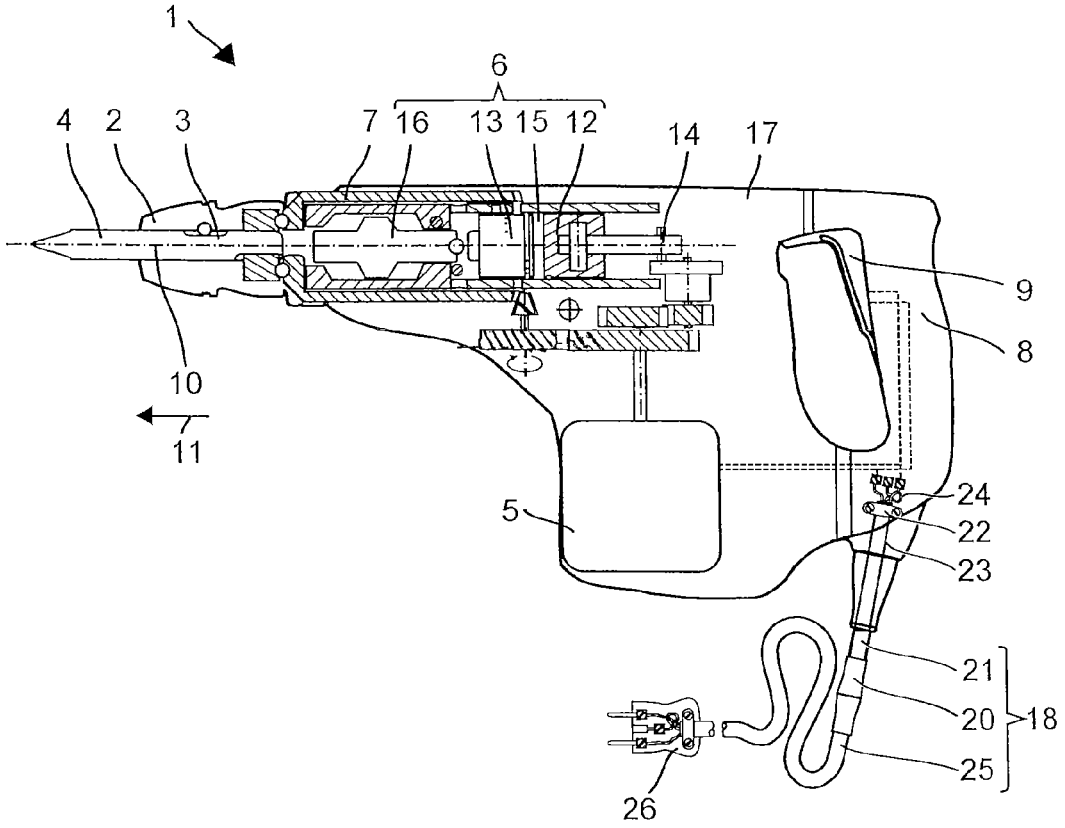
FIG. 1 illustrates a hammer drill.

FIG. 1 schematically shows a hammer drill 1 as an example of a chiseling hand-held power tool. The hammer drill 1 has a tool receptacle 2, in which a shaft end 3 of a tool, for example, of a boring tool 4, may be inserted. A motor 5, which drives a striking mechanism 6 and an output shaft 7, forms a primary drive of the hammer drill 1. An operator is able to guide the hammer drill 1 by a hand grip 8 and put the hammer drill 1 into operation using a system switch 9. During operation, the hammer drill 1 rotates the boring tool 4 continuously around a working axis 10 and, in doing so, is able to hit the boring tool 4 in the impact direction 11 along the working axis 10 into a substrate.

The striking mechanism 6 is a pneumatic striking mechanism, for example. An exciter 12 and a striking device 13 are movably guided in the striking mechanism 6 along the working axis 10.

The exciter 12 is coupled with the motor 5 via an eccentric 14 or a wobble finger and forced into a periodic, linear movement. A pneumatic spring formed by a pneumatic chamber 15 between the exciter 12 and striking device 13 couples a movement of the striking device 13 to the movement of the exciter 12. The striking device 13 is able to strike directly on a rear end of the boring tool 4 or indirectly transmit a portion of its impulse to the boring tool 4 via an essentially resting intermediate striking device 16. The striking mechanism 6 and preferably the other drive components are disposed inside a machine housing 17.

Power is supplied to the hammer drill 1 using a supply cable 18 connected to a network. The supply cable 18 is provided with a plug connection 20 outside the machine housing 17, which makes it possible to disconnect the supply cable 18 electrically and mechanically. A machine-side section 21 of the supply cable 18 is fastened in an undetachable fashion inside the machine housing 17. For example, a strain relief 22 clamps a jacket 23 of the supply cable 18 and protects stranded wires 24 of the supply cable 18 from mechanical loads. The stranded wires 24 are electrically connected directly or indirectly to the motor 5 and, as the case may be, to the system switch 9. A network-side section 25 of the supply cable 18 has a country-specific connector plug 26 for a power supply network, e.g., according to the IEC 60309 standard. The machine-side section 21 is expediently only a few decimeters long. The machine-side section 21 is advantageously shorter than the distance from the strain relief 22 to the tool receptacle 2. Therefore, damage to the machine-side section 21 from the hammer drill 1 is preventable. In the event of damage to the section 25 on the network side, this section is able to be detached and replaced by opening the plug connection 20.

Figure 2:
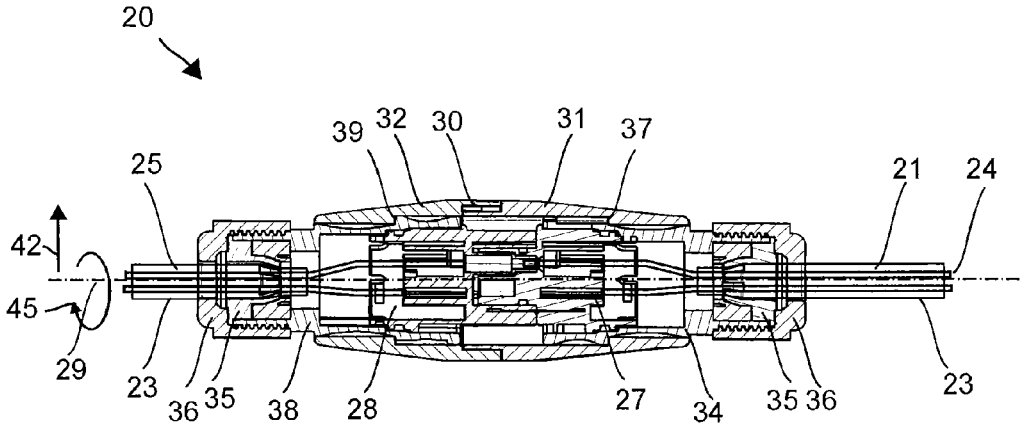
FIG. 2 illustrates a first embodiment of a plug connection.

FIG. 2 shows an embodiment of the plug connection 20. The plug connection 20 includes a socket 27 and a plug 28 for an electrical contacting. The socket 27 is preferably connected to the stranded wires 24 of the section 21 on the machine-side section 21. The complementary plug 28 for the socket 27 is connected to the stranded wires 24 in the network-side section 25. The plug 28 is able to be inserted into the socket 27 along an axis 29 to close an electrical connection from the connector plug 26 to the hammer drill 1.

A mechanical locking 30 of the plug connection 20 is accomplished via two interlocking sleeves 31, 32. The sleeves 31, 32 are arranged coaxially to the axis 29 and, preferably, completely cover the electrical plug connection.

One of the sleeves 31 is fastened to the jacket 23 of the machine-side section 21 and the other of the sleeves 32 to the jacket 23 of the section 25 on the network side. The first sleeve 31 is mounted on the plug 28 so it can rotate around the axis 29. The plug 28 may have for example a housing shell 34, which is applied to the jacket 23 via a clamp 35. A nut 36 screwed onto the clamp 35 is able to lock the clamp 35. The housing shell 34 forms a limit stop 37 pointing away from the second sleeve 32, on which limit stop the first sleeve 31 is adjacent or comes to rest with a closed plug connection 20. As a result, the first sleeve 31 is not able to be pulled out of the supply cable 18. The second sleeve 32 is fastened to the socket 27 and the housing shell 38 thereof and blocked from being pulled out in the direction of the first sleeve 31 by a limit stop 39.

Figure 3:
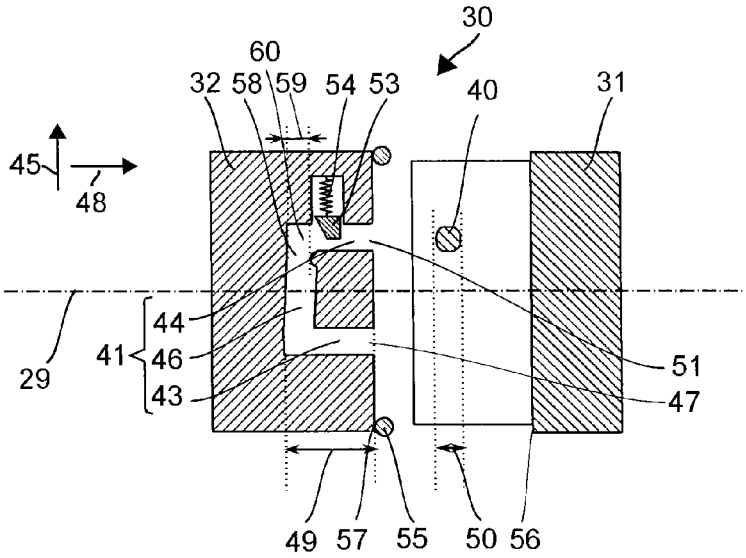
FIG. 3 illustrates a connecting member of a mechanical lock of the plug connection.

The first sleeve 31 has a radially protruding peg 40. The second sleeve 32 has a U-shaped connecting member that is open towards the axis 29 along the radial direction, in which connecting member the peg 40 is able to be inserted. The connecting member 41 is formed by a first longitudinal groove 43, which runs along the axis 29, a second longitudinal groove 44, which runs along the axis 29, and a transverse groove 46 connecting the two longitudinal grooves 43, 44 in the circumferential direction 45 (FIG. 3). The first longitudinal groove 43 forms a first opening 47 of the connecting member 41, which is open in the direction 48 of the first sleeve 31. The longitudinal groove 43 runs monotonically from the first opening 47 along the axis 29. The depicted embodiment shows a longitudinal groove 43 parallel to the axis 29; other embodiments may have a first longitudinal groove 43 inclined with respect to the axis 29, in particular against the direction 48, i.e., in the plugging direction, inclined towards the second longitudinal groove 44. A width of the first longitudinal groove 43, i.e., a dimension in the circumferential direction 45 around the axis 29, is approximately equal to a width of the peg 40. A length 49 of the first longitudinal groove 43, i.e., a dimension along the axis 29, is greater than a length 50 of the peg 40. The peg 40 is able to be countersunk completely in the first longitudinal groove 43 by insertion along the axis 29. The second longitudinal groove 44 forms a second opening 51 of the connecting member 41, which, like the first opening 47, is open in the direction 48 of the first sleeve 31. The second longitudinal groove 44 likewise runs monotonically along the axis 29. Dimensions of the second longitudinal groove 44, in particular a width, correspond preferably to the dimensions of the first longitudinal groove 43. The two longitudinal grooves 43, 44 are arranged offset from one another in the circumferential direction 45. The transverse groove 46 connects the respective ends of the two longitudinal grooves 43, 44 that are away from the openings 47, 51. The transverse groove 46 is closed in the direction 48 of the first sleeve 31. A dimension 59 of the transverse groove 46 along the axis 29 is approximately equal to the length 50 of the peg 40. A relative twisting of the first sleeve 31 with respect to the second sleeve 32 guides the peg 40 through the transverse groove 46 from an unlocked position from the first longitudinal groove 43 into a locked position in the second longitudinal groove 44. In the case of a tensile load, the connecting member 41 guides the peg 40 from the unlocked position through the first longitudinal groove 43 to the first opening 47 and from the locked position through the second longitudinal groove 44 to the second opening 51.

A spring-loaded cam 53 projects into the second longitudinal groove 44. The cam 53 inhibits the peg 40 from exiting through the second opening 51 of the connecting member 41. Manually loosening the lock is accomplished by turning the peg back into the unlocked position in the first longitudinal groove 43. However, in the case of a great tensile force, it is possible for the cam 53 to be pushed out of the longitudinal groove 44 against the spring 54 by the peg. The peg 40 is able to leave the second longitudinal groove 44 at the second opening 51. The required tensile force is, for example, more than 150% of the weight force of the hammer drill 1 and is less than 200% of its weight force. In the case of the depicted embodiment, the spring-loaded cam 53 is configured as a helical spring. Alternatively, the cam 53 may be impressed in a leaf spring. The spring-loaded cam 53 is preferably deflected only in the circumferential direction 45.

A bayonet lock is able to ensure a proper locking of the peg 40 in the locked position in the second longitudinal groove 44. The transverse groove 46 is inclined from the first longitudinal groove 43 to the second longitudinal groove 44 in the direction of the opening 51. The transverse groove 46 may be bent or straight. An elastic ring 55 exerts an axial force on the peg 40, when the peg is inserted into the transverse groove 46. The elastic ring 55 is disposed between two opposing face surfaces 56, 57 of the sleeves 31, 32. The diagonally running transverse groove 46 converts the axial force into a force driving in the circumferential direction 45.

The transverse groove 46 may have a constriction 58, whose dimension 59 along the axis 29 is slightly less than the length 50 of the peg 40, e.g., 2% to 5%. An operator senses the constriction 58 as a pressure point and therefore, when overcoming the constriction, receives feedback that the peg 40 is properly locked and is situated in the rear end 60 of the second longitudinal groove 44. Alternatively or additionally, a radial projection may form a pressure point.

Figure 4:
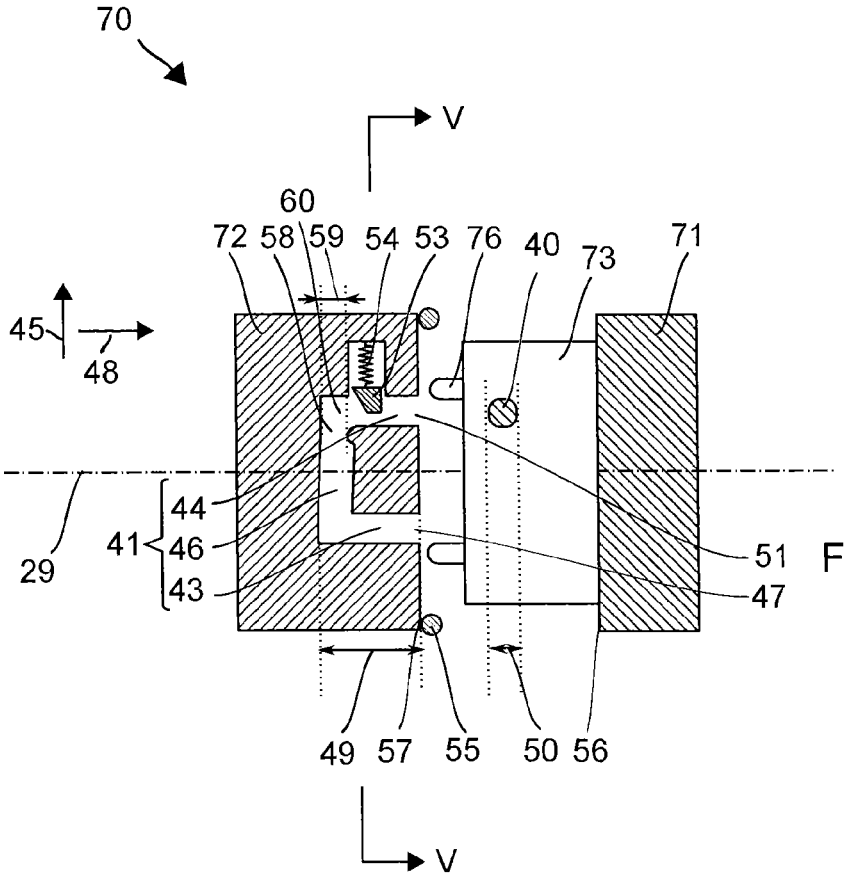
FIG. 4 illustrates a second embodiment of a plug connection.
Figure 5:
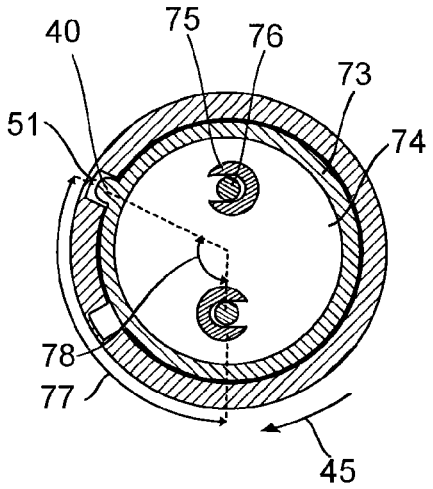
FIG. 5 is a cross-section through the plug connection of FIG. 4 in plane V-V.

FIG. 4 shows an alternative embodiment of the plug connection 70 in an open state and FIG. 5 shows a cross-section of plane V-V in a locked state. Like the foregoing embodiment, a first sleeve 71 is configured with a peg 40 and a second sleeve 72 with a connecting member 41. The first sleeve 71 encloses a plug 73 and is immovable with respect to the plug 73. A housing shell of the plug 73 and the first sleeve 71 may be adhered or locked together, for example. The second sleeve 72 analogously encloses a socket 74 associated with the plug 73 and is connected immovably therewith. When mechanically locking the first sleeve 71 with the second sleeve 72, an electrical connection between the socket 74 and the plug 73 is not established until the peg 40 is locked in the connecting member 41 by a relative rotary movement of the first sleeve 71 with respect to the second sleeve 72.

Contacts 75 of the socket 74 are open on one side in the circumferential direction 45 and are configured, for example, as spring terminals that are open in the circumferential direction 45. The pin-like contacts 76 of the plug 73 are able to be inserted in the laterally open contact 75 in the circumferential direction 45. An angular distance 77 of the second opening 51 to a contact 75 of the socket 74 is approximately equal to an angular distance 78 of the peg 40 to the associated pin-like contact 76 of the plug 73. An electrical connection is not produced until the peg 40 is in the axial extension of the second opening 51; before this the two contacts 75, 76 are separate.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A hand-held power tool, comprising:

a tool receptacle;

an electric motor, wherein the tool receptacle is drivable by the electric motor;

a machine housing; and a supply cable, wherein the supply cable includes:

a first section, wherein the first section is fastened inside the machine housing;

a second section; and a detachable plug connection, wherein the detachable plug connection couples the first section to the second section outside of the machine housing and wherein a locking mechanism of the detachable plug connection is lockable by rotating the locking mechanism around an axis and is unlockable along the axis upon application of a tensile load above a limit value;

wherein a first half of the locking mechanism contains a peg and a second half of the locking mechanism contains a connecting member, wherein the peg is guidable in the connecting member, wherein the connecting member includes a first opening and a second opening that point in a direction of the first half of the locking mechanism and that are arranged offset from each other in a circumferential direction, and wherein a spring-loaded barrier element is engageable in the connecting member.

2. The hand-held power tool according to claim 1, wherein the connecting member includes a longitudinal groove that runs from the second opening and beyond the spring-loaded barrier element.

3. The hand-held power tool according to claim 1, wherein the connecting member includes a second groove that runs between the first opening and the spring-leaded barrier element and wherein the second groove includes a change in direction with respect to the axis.

4. The hand-held power tool according to claim 3, wherein the change in direction runs parallel to the circumferential direction and ends adjacent to the spring-loaded harrier element.

5. The hand-held power tool according to claim 1, wherein the first half of the locking mechanism includes a first sleeve from which the peg projects radially, wherein the second half of the locking mechanism includes a second sleeve that contains the connecting member, and wherein the connecting member is a groove in the second sleeve.

6. The hand-held power tool according to claim 5, wherein the first sleeve and the second sleeve enclose an electrical contact area.

7. The hand-held power tool according to claim 6, wherein the electrical contact area includes a socket with a first electrical contact and a plug with a second electrical contact, wherein the first electrical contact is open in the circumferential direction for receiving the second electrical contact.

8. The hand-held power tool according to claim 7, wherein an angular alignment of the first electrical contact with respect to the peg is equal to an angular alignment of the second electrical contact with respect to the second opening of the connecting member.

* * * * *